United States Patent [19]

Rodway

[11] 4,301,998

[45] Nov. 24, 1981

[54] VERTICAL GUNNING APPARATUS WITH TELEVISION MONITOR

[75] Inventor: Jack L. Rodway, Vienna, Ohio

[73] Assignee: Pfizer Inc., New York, N.Y.

[21] Appl. No.: 143,952

[22] Filed: Apr. 25, 1980

[51] Int. Cl.[3] ..... C21B 7/04

[52] U.S. Cl. ..... 266/281; 239/71; 239/225; 239/227; 118/713

[58] Field of Search ..... 266/272, 273, 280, 281, 266/287; 239/225, 227, 71, 72, 73; 264/30; 118/713

[56] References Cited

U.S. PATENT DOCUMENTS

| | | | |
|---|---|---|---|
| 3,609,236 | 9/1971 | Heltman | 178/7.92 |
| 3,797,745 | 3/1974 | Haus | 239/227 |
| 3,799,445 | 3/1974 | Marino | 239/242 |
| 4,099,708 | 7/1978 | Morris | 266/281 |
| 4,163,546 | 8/1979 | Morris | 266/281 |
| 4,211,367 | 7/1980 | Allison | 239/226 |
| 4,218,989 | 8/1980 | Fujita et al. | 118/713 |

FOREIGN PATENT DOCUMENTS

| | | |
|---|---|---|
| 2626421 | 12/1976 | Fed. Rep. of Germany . |
| 2641382 | 3/1977 | Fed. Rep. of Germany . |

*Primary Examiner*—L. Dewayne Rutledge
*Assistant Examiner*—John P. Sheehan
*Attorney, Agent, or Firm*—Charles J. Knuth; Peter C. Richardson; Harold W. Ordway

[57] ABSTRACT

A remote control gunning apparatus for repairing the refractory lining of a metallurgical vessel in the vertical position at elevated temperature including a water-jacketed television camera for televising the interior of the vessel to detect the eroded areas and monitor the repair thereof, the camera jacket being provided with a transparent heat-resistant port in the line of sight of the lens of the camera, an electrical conduit for supplying power to the camera and for transmitting a televised signal from the camera to a monitor outside the vessel, an air conduit for supplying pressurized air to cool and clean the port, and cooling water conduits concentric with and jacketing the electrical conduit and a substantial portion of the air conduit and connected with the camera jacket.

9 Claims, 5 Drawing Figures

VERTICAL GUNNING APPARATUS WITH TELEVISION MONITOR

BACKGROUND OF THE INVENTION

This invention concerns refractory lining repair. More specifically, it concerns an apparatus for the monitoring and repair of the refractory lining of metallurgical vessels in the vertical position at elevated temperature.

Apparatus, such as those disclosed in U.S. Pat. Nos. 3,797,745 and 3,799,445, are known for the gunning of the vertical walls of refractory vessels such as ladles and electrical steelmaking furnaces by remote control while the vessel is at elevated temperature. These devices, however, are limited to applications where the operator can safely see the area being gunned. A great need still exists for a unit which can be used under conditions, such as with upright basic oxygen furnaces between heats, where the operator cannot approach and observe the lining repair area. It is therefore a primary objective of the present invention to provide a gunning apparatus for the repair of such vessel linings at or near steelmaking temperature which visually monitors the repair operation and thereby allows for a more effective and efficient application of the repair material.

A nonvisual means of repairing refractory linings of metallurgical vessels in which the damaged zones of the lining are repaired using a spraying nozzle controlled by a water-cooled microwave scanner is disclosed in German Offenlegungsschrift No. 2626421.

Visual monitoring of hot refractory linings is disclosed in U.S. Pat. No. 3,609,236, in which a cooled and purged television camera and lens assembly is mounted on a powered operator adjacent an apertured hazardous chamber such as a high-temperature furnace, and in German Offenlegungsschrift No. 2641382, in which a water-cooled television camera housing with air-cooled zoom lens is moveably supported to observe the interior surface of refractory chambers such as a coke oven at temperatures of up to 1200° C.

SUMMARY OF THE INVENTION

The remote control gunning apparatus of the present invention comprises in combination a rotatable vertical gunning conduit terminating at its lower extremity in a nozzle; swivel coupling means for supplying a fluidized stream of particulate refractory under pressure to the conduit; means for moving the conduit horizontally and vertically to position the nozzle inside the vessel adjacent a lining area to be repaired; means for rotating the conduit to aim the refractory stream from the nozzle at the area; a water-jacketed television camera attached to the conduit proximate the nozzle for televising the interior of the vessel to detect the area and to monitor the repair thereof, the axis of the camera being canted to substantially converge with the axis of the nozzle at the area, the camera jacket being provided with a transparent heat-resistant port in the line of sight of the lens of the camera; an electrical conduit for supplying power to the camera and for transmitting a televised signal from the camera to a monitor outside the vessel; an air conduit for supplying pressurized air to the port to cool and clean the port; a first cooling water conduit concentric with and jacketing the electrical conduit and connected with the camera jacket; and a second cooling water conduit concentric with and jacketing a substantial portion of the air conduit and connected with the camera jacket.

In preferred embodiments, the apparatus has a mixing head for mixing water with the particulate refractory for the fluidized stream; the nozzle extends from the conduit at a substantially right angle; the monitor comprises a video screen; the apparatus is constructed and arranged to introduce cooling water to the camera jacket through the first water conduit and to conduct heated cooling water from the camera jacket through the second water conduit; the apparatus has a temperature sensing means within the camera jacket and signal transmitting means within the electrical conduit connected to the sensing means and to a remote temperature indicating station; and the camera jacket and water conduits are insulated.

BRIEF DESCRIPTION OF THE DRAWINGS

The above and other objects, features and advantages of the present invention will be apparent from the following detailed description of an embodiment thereof in conjunction with the accompanying drawings wherein like reference numerals indicate like structures throughout the several views.

DESCRIPTION OF THE PREFERRED EMBODIMENTS

Figure 1:
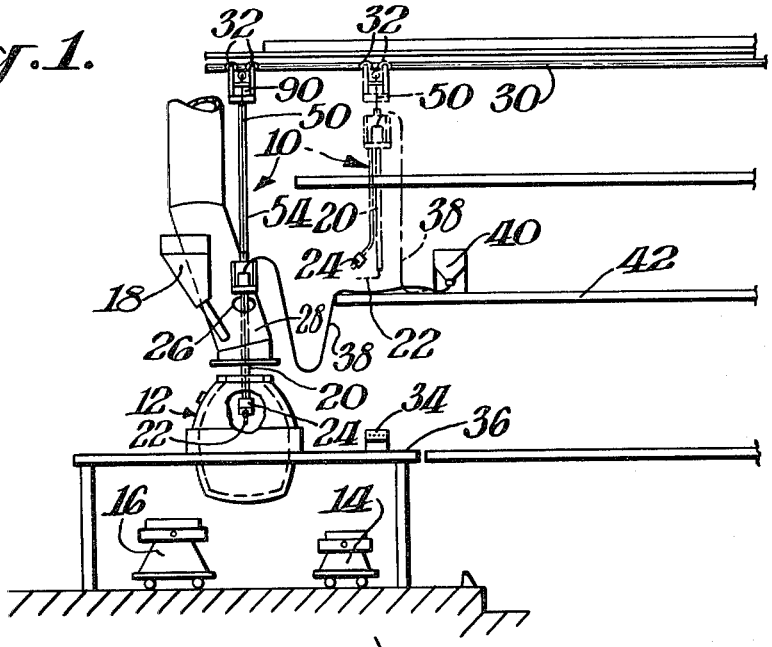
FIG. 1 is a diagramatic view of a BOF arrangement showing the gunning apparatus of the present invention within the BOF in the vertical position and, in phantom outline, outside the BOF.

FIG. 1 depicts a preferred embodiment of the gunning apparatus of the present invention, designated generally by reference numeral 10, in conjunction with a basic oxygen furnace (BOF) 12 shown in the vertical position, such as at the completion of a steelmaking cycle when the BOF 12 has discharged the slag and molten steel product from the cycle to slag pot 14 and teeming ladle 16, respectively, and is awaiting the next charge to be added through batching hopper 18. At this point in the steelmaking process, the interior of the BOF 12 is at or slightly below the steelmaking temperature, which, depending upon the steel being produced, will normally be from about 1500° to 1700° C.

Gunning apparatus 10 comprises a rotatable vertical gunning conduit 20 terminating at its lower extremity in a nozzle 22. Preferably, nozzle 22 extends from gunning conduit 20 at substantially a right angle as shown, although either an acute or obtuse angle may be employed. Gunning apparatus 10 further includes a water-jacketed television camera assembly 24 attached to gunning conduit 20 proximate nozzle 22 for televising the interior of BOF 12 to detect and monitor the repair of eroded lining areas within BOF 12.

Gunning apparatus 10 enters BOF 12 through the oxygen lance opening 26 in hood 28. In this operation, gunning apparatus 10 is moved along horizontal guideway 30 above BOF 12 by means of a set of rollers 32 actuated by a drive motor, not shown, until gunning apparatus 10 is directly over opening 26. Then, as more clearly shown in FIGS. 2 and 3, gunning apparatus 10 is lowered by means of cable 50 into BOF 12, the gunning apparatus 10 being guided by double-flanged wheels 52 riding on vertical guideways 54. This and all other operations of gunning apparatus 10 are controlled remotely by an operator stationed at control station 34 located on the operating floor 36 of the steelmaking shop. Control station 34 includes, for example, a video monitor which receives a television signal from television camera assembly 24 and comprises a video screen to observe and assist in the repair operation with or without a video recorder to provide a permanent record of the repair operation.

Figure 2:
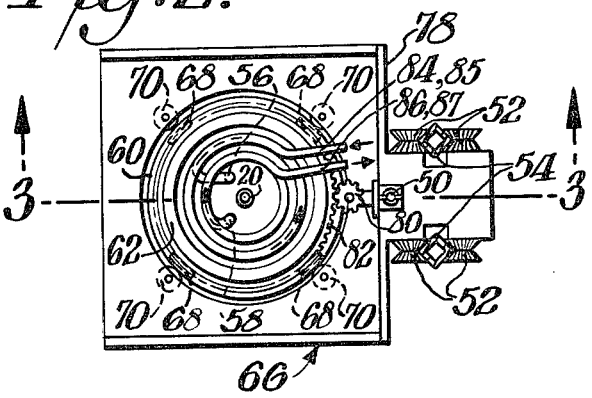
FIG. 2 is a top plan view of the gunning apparatus of the present invention.
Figure 3:
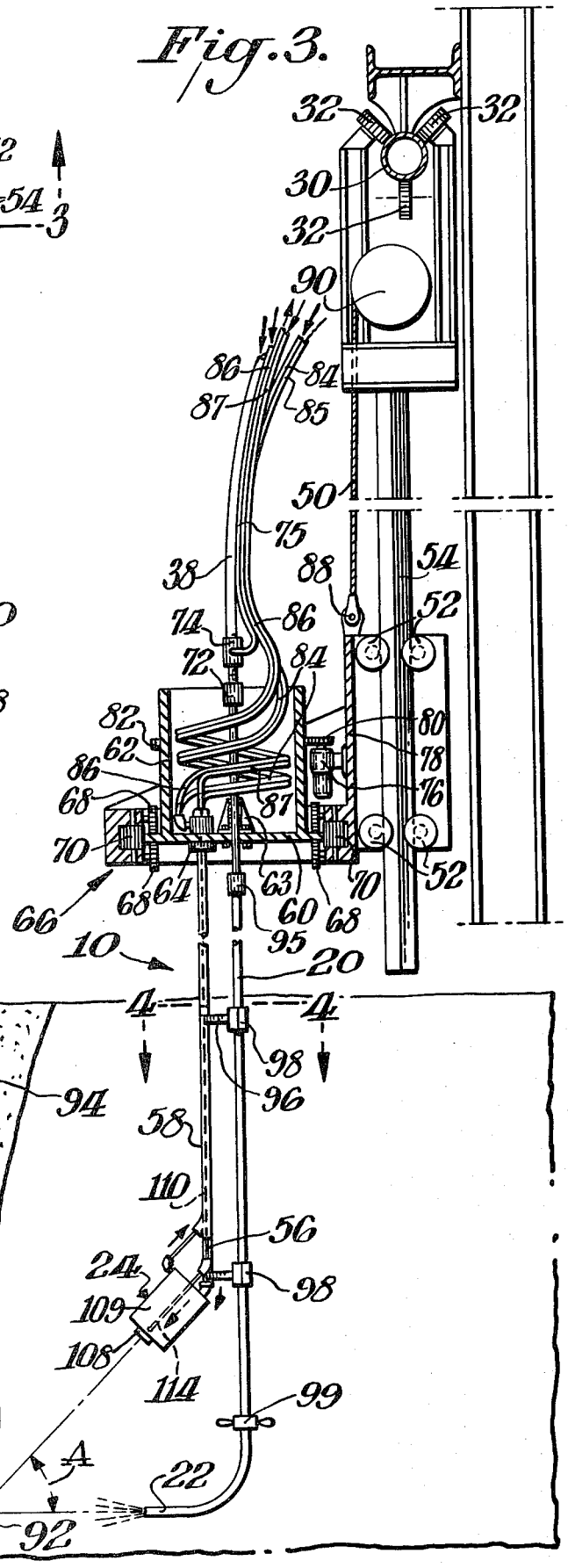
FIG. 3 is a cross-sectional view in elevation of the apparatus of the present invention within the BOF taken through FIG. 2 along the line 3—3.

FIGS. 2 and 3 show the construction and operation of gunning apparatus 10 in greater detail. In this embodiment, gunning conduit 20 as well as cooling water conduits 56 and 58, which respectively conduct cooling water to, and heated exit water from, television camera assembly 24, pass through near their upper ends a horizontal circular platform 60 having an uprising cylindrical wall 62. The conduits 20,56,58 are fixedly attached to platform 60, gunning conduit 20 through bracket 63 and water conduits 56,58 through bushings 64. Platform 60 in turn is rotatably attached to and supported by vertical cart assembly 66 through support bearings 68 and guide bearings 70.

Gunning conduit 20 at its upper end is connected to swivel coupling 72, which supplies a fluidized stream of particulate refractory under pressure through refractory supply hose 38 from a pneumatic gun 40 located on service floor 42, as shown in FIG. 1. The stationary portion of swivel coupling 72 includes a mixing head 74 for mixing water from water supply hose 75 with the fluidized particulate refractory. A gear motor 76 is fixedly attached to the backplate 78 of vertical cart assembly 66 to supply rotary motion to platform 60, and thus to gunning conduit 20; this is accomplished by the intermeshing of motor gear 80 on the shaft of gear motor 76 with platform gear 82 on the outer surface of cylindrical wall 62.

Figure 5:
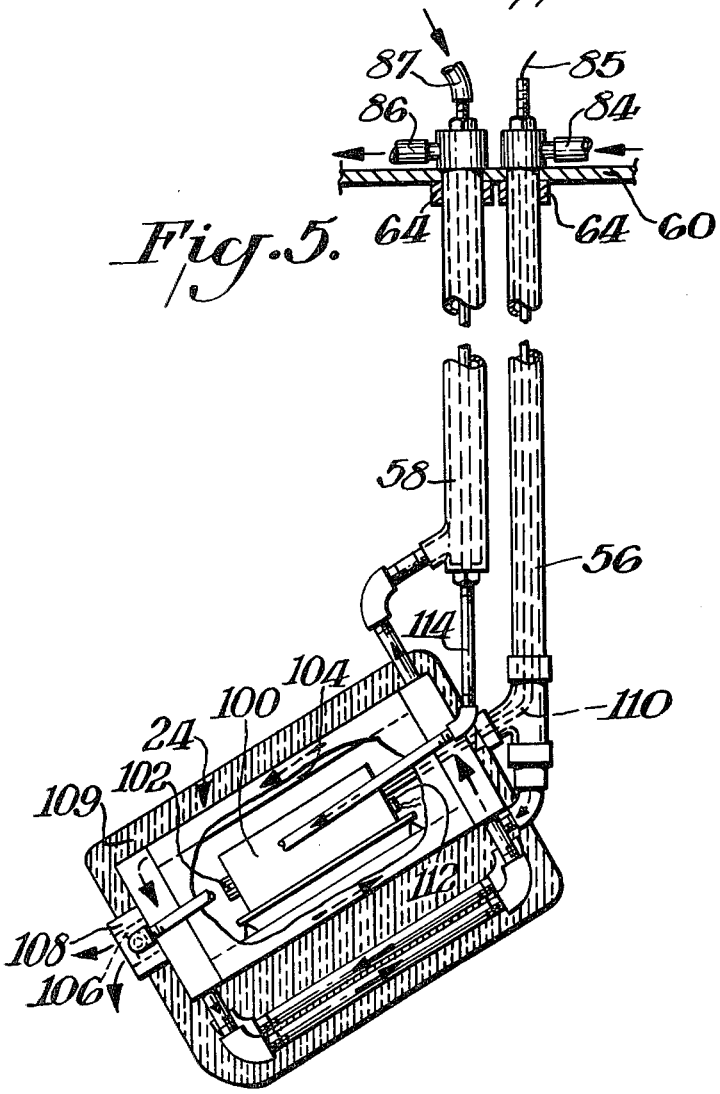
FIG. 5 is a side elevational view, with portions broken away, of the camera assembly of the gunning apparatus of the present invention, including a distorted diagramatic view of the cooling conduits to more clearly show their relationship to the camera assembly.

The upper ends of water conduits 56,58, slightly above platform 60, are connected as shown in FIG. 5 through nipples to flexible water hoses 84,86 partially spring coiled as shown in FIG. 3 within cylindrical wall 62; the other end of cooling hose 84 is connected to a source of cooling water and that of exit hose 86 to a water drainage line.

Electrical cable 85, emerging from the upper end of electrical conduit 110, and air hose 87, connected through a nipple to the upper end of air conduit 114, as shown in FIG. 5, are likewise partially spring coiled with water hoses 84,86 within cylindrical wall 62, as shown in FIG. 3. The other end of air hose 87 is connected to an air supply, not shown, and the wires within cable 85 to their respective terminals at control station 34. Electrical conduit 110 and air conduit 114 are discussed hereinafter.

The above arrangement permits gear motor 76 to rotate platform 60, and thus gunning conduit 20, about 1.25 turns, or 450°, in either a clockwise or counterclockwise direction. Since gear motor 76 is of variable speed, the rotation of platform 60 is adjustable from about 0.25 to 4.0 RPM.

As discussed hereinbefore, gunning apparatus 10 is raised and lowered through the action of cable 50, the gunning apparatus 10 being guided by wheels 52 riding on vertical guideways 54. As seen in FIG. 3, cable 50 is attached to backplate 78 of vertical cart assembly 66 through pin 88 and is coiled and uncoiled about pulley wheel 90 by the action of a drive motor, not shown. The wheels 52 attached to vertical cart assembly 66 and riding on vertical guideways 54 provide a steady vertical movement of the gunning apparatus 10.

FIG. 3 also shows the relationship of nozzle 22 and television camera assembly 24 of gunning apparatus 10 to an eroded area 92 in refractory lining 94 of BOF 12. Thus, television camera assembly 24 is attached to gunning conduit 20 proximate nozzle 22 with the axis of television camera housing 24 canted with respect to the axis of nozzle 22 such that the two axes substantially converge at area 92. As shown, the angle of cant A is about 45 degrees. This arrangement allows for a clear viewing by television camera assembly 24 of area 92 and its repair.

Figure 4:
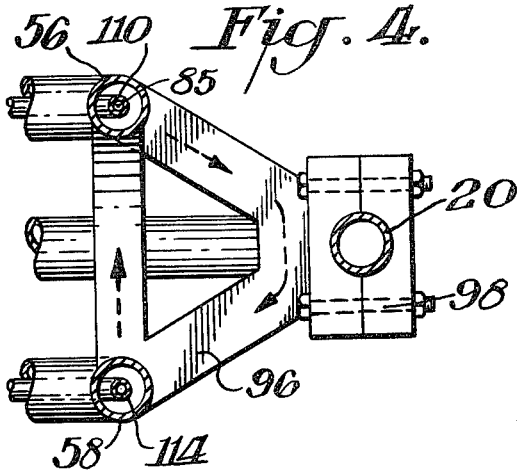
FIG. 4 is a cross-sectional plan view taken through FIG. 3 along the line 4—4.

FIG. 4 shows in detail the arrangement of gunning conduit 20 with respect to water conduits 56,58. In this arrangement, gunning conduit 20, cooling water conduit 56 and exit water conduit 58 are held in fixed spaced relationship by hollow brace 96, the brace 96 being attached to gunning conduit 20 through clamp 98 and cooled by water diverted from cooling water conduit 56.

FIGS. 3 and 4 further show the replaceable nature of gunning conduit 20 and nozzle 22. Thus, gunning conduit 20 comprises lengths of pipe joined by conduit couplings 95 and removably attached to braces 96 through clamps 98, while nozzle 22 is removably attached to gunning conduit 20 through nozzle coupling 99.

FIG. 5 shows in greater detail the cooling arrangement and operation of television camera assembly 24, which comprises a closed-circuit television camera 100 with filter-equipped lens 102 mounted within a water-cooled cylindrical jacket or housing 104 such that the line of sight of lens 102 is substantially along the axis of housing 104. That end of housing 104 in the line of sight of lens 102 is provided with a transparent heat-resistant port 106 having a hollow cylindrical shield 108. Port 106 is made of such as borosilicate glass. Water conduits 56,58 are each connected through piping with housing 104 such that cooling water enters housing 104 through cooling water conduit 56, circulates throughout housing 104 and exits at a slightly elevated temperature through exit water conduit 58. To further protect camera 100 from the intense heat within BOF 12, camera assembly 24, except for the open end of shield 108, is covered with blanket insulation 109. Water conduits 56,58 are likewise covered with blanket insulation, not shown.

Within cooling water conduit 56, as shown in FIGS. 4 and 5, is a concentric electrical conduit 110 carrying lines for supplying power to camera 100 as well as for transmitting the signal from camera 100 to a video monitor at control station 34. Electrical conduit 110 also carries a line for transmitting the signal from a thermocouple or other temperature probe 112 aside camera 100 within jacket 104 to an indicator/recorder located at control station 34.

Connected to shield 108 is an air conduit 114 for supplying pressurized air to cool and clean port 106. As shown in FIGS. 4 and 5, air conduit 114 is concentric with and jacketed by exit water conduit 58 for a substantial portion of its length to prevent the temperature of the air within air conduit 114 from rising substantially. Shield 108 comprises two thin-walled concentric cylinders, closed together at one end, and is removably attached to housing 104 at its base. The outer cylinder of shield 108 is connected to air conduit 114 while the inner cylinder has a narrow slot around its circumference at its base just in front of port 106. Thus, the pressurized air from air conduit 114 blows through the slot of shield 108 across the surface of port 106 and out the open end of the shield 108, thereby insulating port 106 from the heat and contamination of the gunning operation.

As described hereinbefore, the present invention provides a gunning apparatus which is not only capable of repairing the damaged linings of a steelmaking vessel such as a BOF in its vertical position at or near its steelmaking temperature, even during the steelmaking process itself, but further allows an operator at a safe distance from the vessel to see and record the repair operation as if he were at the repair site within the vessel. By the disclosed unique arrangement of service lines and cooling conduits, a television camera within an environment at a temperature of up to 1700° C. or higher can televise at close range an entire refractory repair operation and itself be maintained at or slightly above room temperature. Under normal conditions, the temperature of the cooling water upon passage through the apparatus will rise about 5° to 15° C. and the cooling air at the site of the camera lens will be about 40° to 70° C.

The present apparatus therefore offers numerous advantages over existing gunning units. For example, since the gunning can be conducted during normal shop delay periods such as pit cleaning and mold delays, greater shop productivity is realized. And since the operator can see precisely what is occurring during the gunning operation, the consequent more efficient gunning results in extended lining life and reduced rebuilds. From the safety standpoint, the present apparatus places the operator at a safe distance from the gunning operation while giving him complete control over it and also clears the operating floor of all cumbersome gunning equipment. The permanent record further allows a careful study of the operation for developing improved techniques and refractory gunning compositions.

While the invention has been described in connection with a preferred embodiment, it also includes alternatives, modifications and equivalents within the spirit and scope of the appended claims. For example, the gunning apparatus can be modified to include a dedicated micro-processor control system for automatically and evenly distributing gunning material to a damaged refractory lining; in such a system, sonar measuring the distance from the nozzle of the gunning apparatus to the refractory wall would continuously relay this information to a computer which would in turn direct the amount of refractory applied to the wall through control of the rotational speed of the nozzle.

I claim:

1. A remote control gunning apparatus for repairing the refractory lining of a metallurgical vessel in the vertical position at elevated temperature, said apparatus comprising in combination a rotatable vertical gunning conduit terminating at its lower extremity in a nozzle, swivel coupling means for supplying a fluidized stream of particulate refractory under pressure to said conduit, positioning means for moving said conduit horizontally and vertically to position said nozzle inside said vessel adjacent a lining area to be repaired, means for rotating said conduit to aim said refractory stream from said nozzle at said area, a television camera attached to said conduit proximate to said nozzle for televising the interior of said vessel to detect said area and to monitor the repair thereof, the axis of said camera being canted to substantially converge with the axis of said nozzle at said area, said camera being mounted in a jacket, said camera jacket being provided with a transparent heat-resistant port in the line of sight of the lens of said camera, a generally vertical elongated water inlet conduit communicating with said camera jacket and connected to a source of water for circulating water throughout the interior of said camera jacket to maintain said camera cool, an elongated water outlet conduit generally parallel to and along side of said water inlet conduit and communicating with said camera jacket for discharging heated water from said interior of said camera jacket, an electrical conduit longitudinally disposed in one of said water conduits for supplying power to said camera for transmitting a televised signal from said camera to a monitor outside said vessel, and an air conduit, a substantial portion of which is longitudinally disposed in the other of said water conduits, communicating with said port for supplying pressurized air to said port to cool and clean said port.

2. The apparatus of claim 1 having a mixing head for mixing water with said particulate refractory for said fluidized stream.

3. The apparatus of claim 1 wherein said nozzle extends from said conduit at a substantially right angle.

4. The apparatus of claim 1 wherein said monitor comprises a video screen.

5. The apparatus of claim 1 having temperature sensing means within said camera jacket and signal transmitting means within said electrical conduit connected to said sensing means and to a remote temperature indicating station.

6. The apparatus of claim 1 wherein said camera jacket and said water conduits are insulated.

7. The apparatus of claim 1, for repairing the refractory lining of a vertically disposed basic oxygen furnace having an opening at its top thereof, said gunning apparatus being mounted to said positioning means located above said opening, said conduits being parallel to each other and extending downwardly into said furnace through said opening.

8. The apparatus of claim 1 including a generally triangularly shaped hollow brace, said gunning conduit being mounted to one corner of said brace, said water inlet conduit being mounted to a second corner of said brace, said water outlet conduit being mounted to the third corner of said brace and the interior of said brace being cooled by water from said water inlet conduit.

9. The apparatus of claim 1 wherein said electrical conduit is disposed concentrically in said inlet water conduit and said air conduit is disposed concentrically in said outlet water conduit.

* * * * *